US005906904A

United States Patent [19]

Parikh et al.

[11] Patent Number: 5,906,904

[45] Date of Patent: May 25, 1999

[54] ELECTROPHOTOGRAPHIC IMAGING MEMBER WITH IMPROVED SUPPORT LAYER

[75] Inventors: Satish R. Parikh, Rochester; Edward F. Grabowski, Webster; Michael S. Roetker, Rochester; Kent J. Evans, Lima, all of N.Y.

[73] Assignee: Xerox Corporation, Stamford, Conn.

[21] Appl. No.: 09/049,377

[22] Filed: Mar. 27, 1998

[51] Int. Cl.[6] ..... G03G 5/10

[52] U.S. Cl. ..... 430/69; 430/58; 430/63

[58] Field of Search ..... 430/69, 63, 58, 430/64, 65

[56] References Cited

U.S. PATENT DOCUMENTS

| | | | |
|---|---|---|---|
| 4,026,703 | 5/1977 | Hayashi et al. | 96/1.5 |
| 4,464,450 | 8/1984 | Teuscher | 430/59 |
| 4,532,166 | 7/1985 | Thomsen et al. | 428/57 |
| 4,587,189 | 5/1986 | Hor et al. | 430/59 |
| 4,588,667 | 5/1986 | Jones et al. | 430/73 |
| 4,780,385 | 10/1988 | Wieloch et al. | 430/58 |
| 4,786,570 | 11/1988 | Yu et al. | 430/58 |
| 4,810,555 | 3/1989 | Shimozawa et al. | 428/141 |
| 4,917,947 | 4/1990 | Kosha et al. | 428/329 |
| 4,925,760 | 5/1990 | Baranyi et al. | 430/59 |
| 4,943,508 | 7/1990 | Yu | 430/129 |
| 4,946,740 | 8/1990 | Ono et al. | 428/323 |
| 5,019,473 | 5/1991 | Nguyen et al. | 430/58 |
| 5,322,755 | 6/1994 | Allen et al. | 430/96 |
| 5,418,100 | 5/1995 | Yu | 430/58 |
| 5,492,785 | 2/1996 | Normandin et al. | 430/69 |
| 5,571,647 | 11/1996 | Mishra et al. | 430/58 |
| 5,571,648 | 11/1996 | Mishra et al. | 430/59 |
| 5,571,649 | 11/1996 | Mishra et al. | 430/59 |
| 5,576,130 | 11/1996 | Yu et al. | 430/58 |
| 5,591,554 | 1/1997 | Mishra et al. | 430/59 |
| 5,643,702 | 7/1997 | Yu | 430/58 |

*Primary Examiner*—Christopher D. Rodee

[57] ABSTRACT

An electrophotographic imaging member including a support substrate layer comprising polyethylene naphthalate substantially free of any oligomers, having a glass transition temperature of between about 100° C. and about 140° C., having a thickness between about 75 micrometers (3 mils) and about 125 micrometers (5 mils) and having a Young's modulus of between about 650,000 and about 1,000,000 pounds per square inch, an electrically conductive ground plane layer c including titanium, a hole blocking layer, an optional adhesive layer, a charge generation layer including photoconductive particles dispersed in a film forming binder, and a hole transport layer, the hole transport layer being substantially non-absorbing in the spectral region at which the charge generation layer generates and injects photogenerated holes but being capable of supporting the injection of photogenerated holes from the charge generation layer and transporting the holes through the hole transport layer.

18 Claims, No Drawings

ELECTROPHOTOGRAPHIC IMAGING MEMBER WITH IMPROVED SUPPORT LAYER

BACKGROUND OF THE INVENTION

This invention relates in general to electrophotography and more specifically, to an electrophotographic imaging member having an improved support layer.

In the art of electrophotography, an electrophotographic plate comprising a photoconductive insulating layer on a conductive layer is imaged by first uniformly electrostatically charging the surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

Electrophotographic imaging members are usually multilayered photoreceptors that comprise a substrate support, an electrically conductive layer, an optional hole blocking layer, an adhesive layer, a charge generating layer, and a charge transport layer in either a flexible belt form or a rigid drum configuration. For most multilayered flexible photoreceptor belts, an anti-curl layer is usually employed on the back side of the substrate support, opposite to the side carrying the electrically active layers, to achieve the desired photoreceptor flatness. One type of multilayered photoreceptor comprises a layer of finely divided particles of a photoconductive inorganic compound dispersed in an electrically insulating organic resin binder. U.S. Pat. No. 4,265,990 discloses a layered photoreceptor having separate charge generating (photogenerating) and charge transport layers. The charge generating layer is capable of photogenerating holes and injecting the photogenerated holes into the charge transport layer. The photogenerating layer utilized in multilayered photoreceptors include, for example, inorganic photoconductive particles or organic photoconductive particles dispersed in a film forming polymeric binder. Inorganic or organic photoconductive material may be formed as a continuous, homogeneous photogenerating layer. Many suitable photogenerating materials known in the art can be utilized, if desired.

As more advanced, higher speed electrophotographic copiers, duplicators and printers were developed, degradation of image quality was encountered during extended cycling. Moreover, complex, highly sophisticated, duplicating and printing systems employed flexible photoreceptor belts, operating at very high speeds, have also placed stringent mechanical requirements and narrow operating limits as well on photoreceptors. For example, the layers of many modern multilayered photoreceptor belt must be highly flexible, adhere well to each other, and exhibit predictable electrical characteristics within narrow operating limits to provide excellent toner images over many thousands of cycles.

An encouraging advance in electrophotographic imaging which has emerged in recent years is the successful fabrication of a flexible imaging member which exhibits excellent capacitive charging characteristic, outstanding photosensitivity, low electrical potential dark decay, and long term electrical cyclic stability. This imaging member employed in belt form usually comprises a substrate, a conductive layer, a solution coated hole blocking layer, a solution coated adhesive layer, a thin charge generating layer comprising a sublimation deposited perylene or phthalocyanine organic pigment or a dispersion of one of these pigments in a selected binder resin, a solution coated charge transport layer, a solution coated anti-curl layer, and an optional overcoating layer.

Multi-layered photoreceptors containing charge generating layers, comprising either vacuum sublimation deposited pure organic pigment or an organic pigment dispersion of perylene or phthalocyanine in a film forming binder exhibit characteristics that are superior to photoreceptor counterparts containing a trigonal selenium dispersion in the charge generating layer. Unfortunately, these multi-layered perylene photoreceptors have also been found to develop a serious charge deficient spots problem, particularly the dispersion of perylene pigment in the matrix of a bisphenol Z type polycarbonate film forming binder. The expression "charge deficient spots" as employed herein is defined as localized areas of dark decay that appear as toner deficient spots when using charged area development, e.g. appearance of small white spots having an average size of between about 0.2 and about 0.3 millimeter on a black toner background on an imaged hard copy. In discharged area development systems, the charge deficient spots appear in the output copies as small black toner spots on a white background. Moreover, multi-layered benzimidazole perylene photoreceptors have also been observed to curl after coating and drying. A curled photoreceptor cannot be electrostatically charged uniformly because different parts of the photoreceptor surface are at different distances from charging devices such as corotrons and scorotrons. Also a curled photoreceptor adversely affects image development and transfer. Further, an upwardly curled edge of a photoreceptor carrying a ground strip along one edge can short out a charging device in electrophotographic imaging machines.

Typically, flexible photoreceptor belts are fabricated by depositing the various layers of photoactive coatings onto long webs which are thereafter cut into sheets. The opposite ends of each photoreceptor sheet are overlapped and ultrasonically welded together to form an imaging belt. When conventional photoreceptor substrates such as polyethylene terephthalate webs are coated and dried, the resulting dried photoreceptor web usually has a pronounced camber which adversely affects the circumference uniformity of welded belts, particularly large welded belts for high volume, high speed electrophotographic duplicators and printers.

In the fabricated belt form, the welded seam of the photoreceptor tends to protrude excessively above the rest of the outer surface of the photoreceptor. This protrusion is undesirable because it collides with cleaning blades and other closely spaced subsystems arranged around the web path. Collisions rapidly wear down cleaning blades and can cause vibrations which adversely affect development and registration of toner images, particularly in color imaging machines. In addition, some photoreceptor belts tend to stretch whereas others tend to shrink during image cycling around support rollers, at least one of the rollers being spring loaded to maintain belt tension. The tendency of some photoreceptors to shrink with cycling is aggravated under high operating temperature conditions such as imaging systems that have a rapid first copy out feature where the fuser temperature is increased dramatically to achieve the shorter fusing times needed for a more rapid first copy out.

Also, when a photoreceptor belt containing a polyethylene terephthalate substrate is placed under high belt tension to help flatten the belt, the high tension, particularly at high operating temperatures, damages the charge transport layer of the photoreceptor. When the belt stretches or shrinks, the relative location changes for different sections of the belt such as the seam and regions for imaging. Such relative location changes are difficult to track and require complex, sophisticated and costly detection and timing equipment.

Photoconductor belts containing polyethylene terephthalate substrates also tend to absorb water under high humidity operating conditions. Absorption of water causes undesirable alteration of the electrical properties of the photoreceptor and can cause it to swell. Photoconductor belts containing polyethylene terephthalate substrates also exhibit a wavy surface pattern on the exposed surface of the charge transport layer due to stress imbalance in the member being coated. This wavy pattern is undesirable because of uneven charging of the photoreceptor, incomplete transfer of toner images, and the formation of dark and light patterns. Photoconductor belts containing polyethylene terephthalate substrates form low frequency ripples in the belt during cycling. These ripples tend to have peaks and valleys that run longitudinally of the belt and, therefore, are parallel to the edges of the belt. The presence of ripples markedly reduces the quality of charging, exposure and final toner image.

Attempts to utilize alternative materials for the substrate layer in a electrophotographic imaging belts have encountered difficulties. For example, substrates comprising polyetheramide or polyvinylidene fluoride (Kynar) cannot be readily welded and therefore are less desirable for photoreceptor substrates. Belt substrates of polyethersulphone (PES) are adversely effected by solvents used in the applied coating layers such as methylene chloride solvents.

Thus, there is a continuing need for improved photoreceptors that exhibit freedom from charge deficient spots and are more resistant to curling, stretching, camber formation, conicity variation.

INFORMATION DISCLOSURE STATEMENT

U.S. Pat. No. 4,026,703 to Hayashi et al., issued May 31, 1997—An electrophotographic photoreceptor is disclosed for producing an electrostatic latent image on the top layer thereof which comprises from the bottom up:

a. a substrate b. a layer of metallic palladium having thickness of from 5A to 1000A.

c. a layer including vitreous selenium having a thickness of from 0.05 to 3 microns and d. a top layer including polyvinyl carbazole represented by a specific formula.

Numerous specific substrates are disclosed including, for example, polyethylene naphthalate.

U.S. Pat. No. 4,532,166 to Thomsen et al., issued Jul. 30,1985—A welded web is disclosed comprising a first edge of a web having at least one aperture overlapping a second edge of a web comprising thermoplastic material on an exposed surface along the second edge to form a region of contiguous contact between the first edge and the second edge, at least a portion of the thermoplastic material at least partially filling the aperture thereby bonding the first edge to the second edge. The web may be formed by a process comprising providing a web having a first edge, providing a web having a second edge, forming at least one aperture in at least the first edge, overlapping the first edge over the thermoplastic material on the exposed surface along the second edge whereby the thermoplastic material on the second edge at least covers the aperture to forma region of contiguous contact adjacent the aperture whereby thermoplastic material from the second edge at least partially fills the aperture thereby bonding the first edge to the second edge. Many specific thermoplastic materials are disclosed including, for example, polyethylenes and terephthalic acid resins.

U.S. Pat. No. 4,946,740 to Ono et al., issued Aug. 7, 1990—A magnetic recording medium is described comprising a non-magnetic support having thereon a first magnetic layer comprising at least about 1.0 part by weight of carbon black having an average primary particle diameter of from about 20 to 80 m$\mu$, per 100 parts by weight of magnetic particles contained in the first magnetic layer; and on the first magnetic layer, a second magnetic layer containing from about 0.1 to less than 1.0 part by weight of carbon black having an average primary particle diameter of from about 20 to 150 m$\mu$, per 100 parts by weight of magnetic particles contained in the second magnetic layer. The medium has excellent electromagnetic characteristics, running durability and heat resistance. Numerous specific nonmagnetic supports are disclosed including, for example, polyethylene naphthalate.

U.S. Pat. No. 4,917,947 to Kosh et al., issued Apr. 17, 1990—A magnetic recording medium is described, comprising a non-magnetic support having provided thereon a magnetic layer comprising a binder having dispersed therein a ferromagnetic powder, in which said magnetic layer contains surface-coated inorganic particles having a Mohs hardness of 5 or more as an abrasive, said coated inorganic particles being present in a larger proportion in the vicinity of the surface of the magnetic layer. The magnetic recording medium has improved electromagnetic characteristics and improved running durability. Numerous specific nonmagnetic supports are disclosed including, for example, polyethylene naphthalate.

U.S. Pat. No. 4,810,555 to Shimozawa, issued Mar. 7, 1989—A magnetic recording medium is disclosed comprising a substrate and a magnetic layer thereon, the magnetic layer is formed by coating a composition of a binder, preferably radiation-curable binder and a plate magnetic material such as hexagonal plate barium or strontium ferrite having an average particle diameter d expressed in $\mu$m and an average flakiness R satisfying certain specific equations, passing the coating through a magnetic field to orient the magnetic plates, and curing the coating. Numerous specific substrates are disclosed including, for example, polyethylene naphthalate.

U.S. Pat. No. 5,571,649 to Mishra et al., issued Nov. 5, 1996—An electrophotographic imaging member is disclosed comprising a support substrate having a two layered electrically conductive ground plane layer comprising a layer comprising zirconium over a layer comprising titanium, a hole blocking layer, an adhesive layer comprising a polymer blend comprising a carbazole polymer and a film forming thermoplastic resin selected from the group consisting of copolyester, polyarylate and polyurethane in contiguous contact with the hole blocking layer, a charge generation layer comprising perylene or a phthalocyanine pigment particles dispersed in a polycarbonate film forming binder in contiguous contact with the adhesive layer, and a hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer.

U.S. Pat. No. 5,591,554 to Mishra et al., issued on Jul. 7, 1997—An electrophotographic imaging member is disclosed including a support substrate having an electrically conductive ground plane layer comprising a layer comprising zirconium over a layer comprising titanium a hole blocking layer, an adhesive layer comprising a polyester film forming resin, an intermediate layer in contact with the adhesive layer, the intermediate layer comprising a carbazole polymer, a charge generation layer comprising a perylene or a phthalocyanine, and a hole transport layer, said hole transport layer being substantially non-absorbing in the spectral region at which the charge generation layer generates and injects photogenerated holes but being capable of supporting the injection of photogenerated holes from said charge generation layer and transporting said holes through said charge transport layer.

U.S. Pat. No. 5,576,130 to Yu et al., issued on Nov. 19, 1996—An electrophotographic imaging member comprising a support substrate having an electrically conductive ground plane layer comprising a layer comprising zirconium over a layer comprising titanium, a hole blocking layer, an adhesive layer comprising a thermoplastic polyurethane film forming resin, a charge generation layer comprising perylene or a phthalocyanine particles dispersed in a polycarbonate film forming binder, and a hole transport layer, said hole transport layer being substantially non-absorbing in the spectral region at which the charge generation layer generates and injects photogenerated holes but being capable of supporting the injection of photogenerated holes from said charge generation layer and transporting said holes through said charge transport layer.

U.S. Pat. No. 5,571,648 to Mishra et al., issued Nov. 5, 1996—An electrophotographic imaging member is disclosed comprising a support substrate having an electrically conductive ground plane layer comprising a layer comprising zirconium over a layer comprising titanium, a hole blocking layer, an adhesive layer comprising a polyester film forming resin, an intermediate layer in contact with the adhesive layer, the intermediate layer comprising a carbazole polymer, a charge generation layer comprising perylene or a phthalocyanine particles dispersed in a polymer binder blend of polycarbonate and carbazole polymer, and a hole transport layer, said hole transport layer being substantially non-absorbing in the spectral region at which the charge generation layer generates and injects photogenerated holes but being capable of supporting the injection of photogenerated holes from said charge generation layer and transporting said holes through said charge transport layer.

U.S. Pat. No. 5,571,647 to Mishra et al., issued Nov. 5, 1996—An electrophotographic imaging member is disclosed including a support substrate having an electrically conductive ground plane layer comprising a layer comprising zirconium over a layer comprising titanium, a hole blocking layer, an adhesive layer comprising a copolyester resin, a charge generation layer comprising a perylene or a phthalocyanine particles dispersed in a film forming resin binder blend, said binder blend consisting essentially of a film forming polyvinyl butyral copolymer and a film forming copolyester, and a hole transport layer, said hole transport layer being substantially non-absorbing in the spectral region at which the charge generation layer generates and injects photogenerated holes but being capable of supporting the injection of photogenerated holes from said charge generation layer and transporting said holes through said charge transport layer.

U.S. Pat. No. 5,643,702 to Yu et al., issued Jul. 1, 1997—An electrophotographic imaging member is disclosed comprising an electrophotographic imaging member comprising a substrate layer having an electrically conductive outer surface, an adhesive layer comprising a thermoplastic polyurethane film forming resin, a thin vapor deposited charge generating layer consisting essentially of a thin homogeneous vacuum sublimation deposited film of an organic photogenerating pigment, and a charge transport layer, the transport layer being substantially non-absorbing in the spectral region at which the charge generation layer generates and injects photogenerated holes but being capable of supporting the injection of photogenerated holes from the charge generation layer and transporting the holes through the charge transport layer.

U.S. Pat. No. 5,322,755 to Allen et al., issued on Jun. 21, 1994—A layered photoconductive imaging member is disclosed comprising a supporting substrate, a photogenerator layer comprising perylene photoconductive pigments dispersed in a resin binder mixture comprising at least two polymers, and a charge transport layer. The resin binder can be, for example, a mixture of polyvinylcarbazole and polycarbonate homopolymer or a mixture of polyvinylcarbazole, polyvinylbutyral and polycarbonate homopolymer or a mixture of polyvinylcarbazole and polyvinylbutyral or a mixture of polyvinylcarbazole and a polyester.

U.S. Pat. No. 5,418,100 to Yu, issued May 23, 1995—Discloses an electrophotographic imaging device fabrication method, in which the solvent used to coat charge transport layer is a solvent to which an underlying adhesive interface layer is substantially insensitive. The charge generating layer used for the imaging device is vacuum sublimation deposited benzimidazole perylene pigment and the adhesive interface layer may, for example, be formed of cross-linked film-forming polymers which are insoluble in a solvent used to apply the charge transport layer.

U.S. Pat. No. 4,925,760 to Baranyi et al., issued May 15, 1990—A layered photoresponsive imaging member is disclosed comprising a supporting substrate, a vacuum evaporated photogenerating layer comprised of certain pyranthrone pigments including tribromo-8,16-pyranthrenedione and trichloro-8,16-pyranthrenedione; and an aryl amine hole transport layer comprised of molecules of a certain designated formula dispersed in a resinous binder.

U.S. Pat. No. 4,780,385 to Wieloch et al., issued Oct. 25, 1988—An electrophotographic imaging member is disclosed having an imaging surface adapted to accept a negative electrical charge, the electrophotographic imaging member comprising a metal ground plane layer comprising zirconium, a hole blocking layer, a charge generation layer comprising photoconductive particles dispersed in a film forming resin binder, and a hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer.

U.S. Pat. No. 4,786,570 to Yu et al., issued Nov. 22, 1988—A flexible electrophotographic imaging member is disclosed which comprises a flexible substrate having an electrically conductive surface, a hole blocking layer comprising an aminosilane reaction product, an adhesive layer having a thickness between about 200 angstroms and about 900 angstroms consisting essentially of at least one copolyester resin having a specified formula derived from diacids selected from the group consisting of terephthalic acid, isophthalic acid, and mixtures thereof and a diol comprising ethylene glycol, the mole ratio of diacid to diol being 1:1, the number of repeating units equaling a number between about 175 and about 350 and having a $T_g$ of between about 50° C. to about 80° C., the aminosilane also being a reaction product of the amino group of the silane with the —COOH and —OH end groups of the copolyester resin, a charge generation layer comprising a film forming polymeric component, and a diamine hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer. Processes for fabricating and using the flexible electrophotographic imaging member are also disclosed.

U.S. Pat. No. 5,019,473 to Nguyen et al., issued May 28, 1991—An electrophotographic recording element is disclosed having a layer comprising a photoconductive perylene pigment, as a charge generation material, that is sufficiently finely and uniformly dispersed in a polymeric binder to provide the element with excellent electrophotographic speed. The perylene pigments are perylene-3,4,9,10-tetracarboxylic acid imide derivatives.

U.S. Pat. No. 4,587,189 to Hor et al., issued May 6, 1986—Disclosed is an improved layered photoresponsive imaging member comprised of a supporting substrate; a vacuum evaporated photogenerator layer comprised of a perylene pigment selected from the group consisting of a mixture of bisbenzimidazo(2,1-a-1',2'-b)anthra(2,1,9-def:6,5,10-d'e'f')diisoquinoline-6,11-dione, and bisbenzimidazo(2,1-a:2',1'-a)anthra(2,1,9-def:6,5,10-d'e'f')diisoquinoline-10,21-dione, and N,N'-diphenyl-3,4,9,10-perylenebis(dicarboximide); and an aryl amine hole transport layer comprised of molecules of a specified formula dispersed in a resinous binder.

U.S. Pat. No. 4,588,667 to Jones et al., issued May 13, 1986—An electrophotographic imaging member is disclosed comprising a substrate, a ground plane layer comprising a titanium metal layer contiguous to the substrate, a charge blocking layer contiguous to the titanium layer, a charge generating binder layer and a charge transport layer. This photoreceptor may be prepared by providing a substrate in a vacuum zone, sputtering a layer of titanium metal on the substrate in the absence of oxygen to deposit a titanium metal layer, applying a charge blocking layer, applying a charge generating binder layer and applying a charge transport layer. If desired, an adhesive layer may be interposed between the charge blocking layer and the photoconductive insulating layer.

U.S. Pat. No. 4,943,508 to Yu, issued Jul. 24, 1990—A process for fabricating an electrophotographic imaging member is disclosed which involves providing an electrically conductive layer, forming an aminosilane reaction product charge blocking layer on the electrically conductive layer, extruding a ribbon of a solution comprising an adhesive polymer dissolved in at least a first solvent on the electrically conductive layer to form a wet adhesive layer, drying the adhesive layer to form a dry continuous coating having a thickness between about 0.08 micrometer (800 angstroms) and about 0.3 micrometer (3,000 angstroms), applying to the dry continuous coating a mixture comprising charge generating particles dispersed in a solution of a binder polymer dissolved in at least a second solvent to form a wet generating layer, the binder polymer being miscible with the adhesive polymer, drying the wet generating layer to remove substantially all of the second solvent, and applying a charge transport layer, the adhesive polymer consisting essentially of a linear saturated copolyester reaction product of ethylene glycol and four diacids wherein the diol is ethylene glycol, the diacids are terephthalic acid, isophthalic acid, adipic acid and azelaic acid, the sole ratio of the terephthalic acid to the isophthalic acid to the adipic acid to the azelaic acid is between about 3.5 and about 4.5 for terephthalic acid; between about 3.5 and about 4.5 isophthalic acid; between about 0.5 and about 1.5 for adipic acid; between about 0.5 and about 1.5 for azelaic acid, the total moles of diacid being in a mole ratio of diacid to ethylene glycol in the copolyester of 1:1, and the $T_g$ of the copolyester resin being between about 32° C. about 50° C.

U.S. Pat. No. 4,464,450 to Teuscher, issued Aug. 7, 1984—An electrostatographic imaging member is disclosed having two electrically operative layers including a charge transport layer and a charge generating layer, the electrically operative layers overlying a siloxane film coated on a metal oxide layer of a metal conductive anode, said siloxane film comprising a reaction product of a hydrolyzed silane having a specified general formula.

SUMMARY OF THE INVENTION

It is, therefore, an object of the present invention to provide an improved photoreceptor member which overcomes the above-noted disadvantages.

It is yet another object of the present invention to provide an improved electrophotographic member exhibiting increased flatness during coating and during image cycling.

It is a further object of the present invention to provide an improved electrophotographic member having greater resistance to stretching or distortion.

It is yet another object of the present invention to provide an improved electrophotographic member having flatter welded joints.

It is still another object of the present invention to provide an improved electrophotographic member having less camber.

It is another object of the present invention to provide an improved electrophotographic member exhibiting more uniform conicity after welding into a belt.

It is yet another object of the present invention to provide an improved electrophotographic member which exhibit greater resistance to the formation of charge deficient spots.

It is still another object of the present invention to provide an improved electrophotographic member that has more stable electrical properties under high humidity operating conditions.

It is another object of the present invention to provide an improved electrophotographic member which is resistant to shrinking.

It is a further object of the present invention to provide an improved electrophotographic member which resists deformation under high temperature drying conditions.

It is yet another object of the present invention to provide an improved electrophotographic member having coatings that are more uniform in thickness.

The foregoing objects and others are accomplished in accordance with this invention by providing an electrophotographic imaging member comprising a support substrate layer comprising polyethylene naphthalate substantially free of any oligomers, having a glass transition temperature of between about 100° C. and about 140° C., having a thickness between about 75 micrometers (3 mils) and about 125 micrometers (5 mils) and having a Young's modulus of between about 650,000 and about 1,000,000 pounds per square inch, an electrically conductive ground plane layer comprising titanium, a hole blocking layer, an optional adhesive layer, a charge generation layer comprising photoconductive particles dispersed in a film forming binder, and a hole transport layer, the hole transport layer being substantially non-absorbing in the spectral region at which the charge generation layer generates and injects photogenerated holes but being capable of supporting the injection of photogenerated holes from the charge generation layer and transporting the holes through the hole transport layer.

This photoreceptor is utilized in an electrophotographic imaging process.

The photoreceptor substrate consists of polyethylene naphthalate. The polyethylene naphthalate substrate is transparent to visible light. This substrate also blocks the transmission of ultraviolet radiation having a wavelength of less than about 380 nanometers emanating from erase lamps such as fluorescent erase lamps, thereby preventing damage to the charge transport layer of the photoreceptor and to charge generating layers containing UV sensitive materials such as vanadyl phthalocyanine. The polyethylene naphthalate substrate should also have a thickness of between about 75 micrometers (3 mils) and about 125 micrometers (5 mils). A thickness of between about 87.5 micrometers (3.5 mils) and about 112.5 micrometers (4.5 mils) is preferred. Optimum results are achieved with a polyethylene naphthalate substrate layer thickness of about 90 micrometers (3.5 mils). When the thickness is less than about 75 micrometers, waviness and ripples become unacceptable because of print and charge nonuniformities. For example, at less than about 75 micrometers (3 mils) thickness, a polyethylene naphthalate substrate unexpectedly forms a photoreceptor that has an early end of life at which point the charge transport layer begins to crack. When the thickness is greater than about 125 micrometers charge transport layer cracks during image cycling. Thus, it is surprising that some polyethylene naphthalate substrate materials at a critical thickness provide superior properties compared to other polyethylene naphthalate materials at different thicknesses. The polyethylene naphthalate in the substrate should be substantially free of any oligomers. The term "oligomers" as employed herein is defined as monomer units such as, for example, dimers, trimers, tetramers and the like in a polymer. The expression "substantially free" as employed herein is defined as present in an amount of less than about 0.5 percent by weight based on the total weight of polyethylene naphthalate in the substrate. Polyethylene terephthalate commonly contains an oligomer content of about 1.5 percent by weight based on the total weight of polyethylene terephthalate in the substrate. When the presence of oligomers in the substrate layer become excessive, the oligomers lead to coating defects in the subsequently applied photoreceptor layers. For example, oligomers can accumulate on rollers in coating applicators and cause charge transport layer blotch and charge generator layer backing roll mottle. The oligomers can also accumulate in coater dryers and be dislodged onto freshly coated webs by coater vibration. Excess reactants should not be used to form the polyethylene naphthalate substrate layer. Generally, excess reactants are utilized to form polyethylene terephthalate substrate layers so that unreacted oligomer materials are present in polyethylene terephthalate substrate layers. The polyethylene naphthalate utilized in the photoreceptors of this invention should have a glass transition temperature of between about 100° C. and about 140° C. In addition, the polyethylene naphthalate should stretch or shrink less than about 0.22 percent at 130° C. and have an oxygen permeability of less than about 12.8 cubic centimeters per square meter per day for a thickness of 25 micrometers (1 mil). Unlike the polyethylene naphthalate substrate of this invention, polyethylene terephthalate has an oxygen permeability of about 52.3 cubic centimeters per square meter per day for a thickness of 25 micrometers (1 mil). The polyethylene naphthalate utilized in the photoreceptors of this invention should also have a Young's modulus of between about 600,000 MPa and about 1,000,000 Mpa. Polyethylene naphthalate having the foregoing properties is commercially available, for example, Kaladex 2000, available from ICI Films or E. I. Du Pont De Nemours & Co. Inc. The substrate may have any suitable shape such as, for example, a flexible web, sheet, belt and the like. Preferably, the final coated substrate support layer is in the form of an endless flexible belt. Attempts to utilize other materials for a substrate layer in a electrophotographic imaging belt have encountered difficulties. For example, substrates comprising polyetheramide or polvinlylidene fluroride (e.g. Kynar) cannot be readily welded and therefore are less desirable for photoreceptor substrates. Belt substrates of polyethersulphome are adversely effected by solvents used in the applied coating layers such as methylene chloride solvents.

The titanium and optional zirconium layers may be formed by any suitable coating technique, such as vacuum deposition. Typical vacuum depositing techniques include sputtering, magnetron sputtering, RF sputtering, and the like. Magnetron sputtering of titanium or zirconium onto a substrate can be effected by a conventional type sputtering module under vacuum conditions in an inert atmosphere such as argon, neon, or nitrogen using a high purity titanium or zirconium target. The vacuum conditions are not particularly critical. In general, a continuous titanium or zirconium film can be attained on a suitable substrate, e.g. a polyester web substrate such as Mylar available from E.I. du Pont de Nemours & Co. Inc. with magnetron sputtering. It should be understood that vacuum deposition conditions may all be varied in order to obtain the desired titanium or zirconium thickness. Typical techniques for forming the titanium and zirconium layers are described in U.S. Pat. Nos. 4,780,385 and 4,588,667, the entire disclosures of being incorporated herein in their entirety.

The conductive layer preferably comprises a plurality of metal layers with the outermost metal layer (i.e. the layer closest to the charge blocking layer) comprising at least 50 percent by weight of zirconium. At least 70 percent by weight of zirconium is preferred in the outermost metal layer for even better results. The multiple layers may, for example, all be vacuum deposited or a thin layer can be vacuum deposited over a thick layer prepared by a different techniques such as by casting. Thus, as an illustration, a zirconium metal layer may be formed in a separate apparatus than that used for previously depositing a titanium metal layer or multiple layers can be deposited in the same apparatus with suitable partitions between the chamber utilized for depositing the titanium layer and the chamber utilized for depositing zirconium layer. The titanium layer may be deposited immediately prior to the deposition of the zirconium metal layer. Generally, for rear erase exposure, a conductive layer light transparency of at least about 15 percent is desirable. The combined thickness of a two layered conductive layer should be between about 100 and about 300 angstroms. A typical zirconium/titanium dual conductive layer has a total combined thickness of about 200 angstroms. Although thicker layers may be utilized, economic and transparency considerations may affect the thickness selected.

Regardless of the technique employed to form the titanium or zirconium layer, a thin layer of titanium or zirconium oxide forms on the outer surface of the metal upon exposure to air. Thus, when other layers overlying the zirconium layer are characterized as "contiguous" layers, it is intended that these overlying contiguous layers may, in fact, contact a thin titanium or zirconium oxide layer that has formed on the outer surface of the metal layer. Ground planes comprising zirconium tend to continuously oxidize during xerographic cycling due to anodizing caused by the passage of electric currents, and the presence of this oxide layer tends to decrease the level of charge deficient spots with xerographic cycling. Generally, a zirconium layer thickness of at least about 60 angstroms is desirable to maintain optimum resistance to charge deficient spots during xerographic cycling. A typical electrical conductivity for conductive layers for electrophotographic imaging members in slow speed copiers is about $10^2$ to $10^3$ ohms/square.

After deposition of at least a titanium metal layer, a hole blocking layer is applied thereto. Generally, electron blocking layers for positively charged photoreceptors allow the photogenerated holes in the charge generating layer at the top of the photoreceptor to migrate toward the charge (hole) transport layer below and reach the bottom conductive layer during the electrophotographic imaging processes. Thus, an electron blocking layer is normally not expected to block holes in positively charged photoreceptors such as photoreceptors coated with charge a generating layer over a charge (hole) transport layer. For negatively charged photoreceptors, any suitable hole blocking layer capable of forming an electronic barrier to holes between the adjacent photoconductive layer and the underlying zirconium or titanium layer may be utilized. A hole blocking layer may comprise any suitable material. Typical hole blocking layers utilized for the negatively charged photoreceptors may include, for example, polyamides such as Luckamide, hydroxy alkyl methacrylates, nylons, gelatin, hydroxyl alkyl cellulose, organopolyphosphazines, organosilanes, organotitanates, organozirconates, silicon oxides, zirconium oxides, and the like. Preferably, the hole blocking layer comprises nitrogen containing siloxanes. Typical nitrogen containing siloxanes are prepared from coating solutions containing a hydrolyzed silane. Typical hydrolyzable silanes include 3-aminopropyl triethoxy silane, (N,N'-dimethyl 3-amino) propyl triethoxysilane, N,N-dimethylamino phenyl triethoxy silane, N-phenyl aminopropyl trimethoxy silane, trimethoxy silylpropyldiethylene triamine and mixtures thereof.

During hydrolysis of the amino silanes described above, the alkoxy groups are replaced with hydroxyl group. An especially preferred blocking layer comprises a reaction product between a hydrolyzed silane and the zirconium and/or titanium oxide layer which inherently forms on the surface of the metal layer when exposed to air after deposition. This combination reduces spots at time 0 and provides electrical stability at low RH. The imaging member is prepared by depositing on the zirconium and/or titanium oxide layer of a coating of an aqueous solution of the hydrolyzed silane at a pH between about 4 and about 10, drying the reaction product layer to form a siloxane film and applying electrically operative layers, such as a photogenerator layer and a hole transport layer, to the siloxane film.

The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. This siloxane coating is described in U.S. Pat. No. 4,464,450 to L. A. Teuscher, the disclosure of thereof being incorporated herein in its entirety. After drying, the siloxane reaction product film formed from the hydrolyzed silane contains larger molecules. The reaction product of the hydrolyzed silane may be linear, partially crosslinked, a dimer, a trimer, and the like.

The siloxane blocking layer should be continuous and have a thickness of less than about 0.5 micrometer because greater thicknesses may lead to undesirably high residual voltage. A blocking layer of between about 0.005 micrometer and about 0.3 micrometer (50 Angstroms–3000 Angstroms) is preferred because charge neutralization after the exposure step is facilitated and optimum electrical performance is achieved. A thickness of between about 0.03 micrometer and about 0.06 micrometer is preferred for zirconium and/or titanium oxide layers for optimum electrical behavior and reduced charge deficient spot occurrence and growth.

The adhesive layer is applied to the charge blocking layer. The adhesive layer may comprise any suitable film forming polymer. Typical adhesive layer materials include, for example, copolyester resins, polyarylates, polyurethanes, blends of resins, and like.

A preferred copolyester resin is a linear saturated copolyester reaction product of four diacids and ethylene glycol. The molecular structure of this linear saturated copolyester in which the mole ratio of diacid to ethylene glycol in the copolyester is 1:1. The diacids are terephthalic acid, isophthalic acid, adipic acid and azelaic acid. The mole ratio of terephthalic acid to isophthalic acid to adipic acid to azelaic acid is 4:4:1:1. A representative linear saturated copolyester adhesion promoter of this structure is commercially available as Mor-Ester 49,000 (available from Morton International Inc., previously available from duPont de Nemours & Co.). The Mor-Ester 49,000 is a linear saturated copolyester which consists of alternating monomer units of ethylene glycol and four randomly sequenced diacids in the above indicated ratio and has a weight average molecular weight of about 70,000. This linear saturated copolyester has a $T_g$ of about 32° C. Another preferred representative polyester resin is a copolyester resin derived from a diacid selected from the group consisting of terephthalic acid, isophthalic acid, and mixtures thereof and diol selected from the group consisting of ethylene glycol, 2,2-dimethyl propane and mixtures thereof; the ratio of diacid to diol being 1:1, where the $T_g$ of the copolyester resin is between about 50° C. about 80° C. Typical polyester resins are commercially available and include, for example, Vitel PE-100, Vitel PE-200, Vitel PE-200D, and Vitel PE-222, all available from Goodyear Tire and Rubber Co. More specifically, Vitel PE-100 polyester resin is a linear saturated copolyester of two diacids and ethylene glycol where the ratio of diacid to ethylene glycol in this copolyester is 1:1. The diacids are terephthalic acid and isophthalic acid. The ratio of terephthalic acid to isophthalic acid is 3:2. The Vitel PE-100 linear saturated copolyester consists of alternating monomer units of ethylene glycol and two randomly sequenced diacids in the above indicated ratio and has a weight average molecular weight of about 50,000 and a $T_g$ of about 71° C.

Another polyester resin is Vitel PE-200 available from Goodyear Tire & Rubber Co. This polyester resin is a linear saturated copolyester of two diacids and two diols where the ratio of diacid to diol in the copolyester is 1:1. The diacids are terephthalic acid and isophthalic acid. The ratio of terephthalic acid to isophthalic acid is 1.2:1. The two diols are ethylene glycol and 2,2-dimethyl propane diol. The ratio of ethylene glycol to dimethyl propane diol is 1.33:1. The Goodyear PE-200 linear saturated copolyester consists of randomly alternating monomer units of the two diacids and the two diols in the above indicated ratio and has a weight average molecular weight of about 45,000 and a $T_g$ of about 67° C.

The diacids from which the polyester resins of this invention are derived are terephthalic acid, isophthalic acid, adipic acid and/or azelaic acid acids only. Any suitable diol may be used to synthesize the polyester resins employed in the adhesive layer of this invention. Typical diols include, for example, ethylene glycol, 2,2-dimethyl propane diol, butane diol, pentane diol, hexane diol, and the like.

Alternatively, the adhesive interface layer may comprise polyarylate (ARDEL D-100, available from Amoco Performance Products, Inc.), polyurethane or a polymer blend of these polymers with a carbazole polymer. Adhesive layers are well known and described, for example in U.S. Pat. No. 5,571,649, U.S. Pat. No. 5,591,554, U.S. Pat. No. 5,576,130, U.S. Pat. No. 5,571,648, U.S. Pat. No. 5,571,647 and U.S. Pat. No. 5,643,702, the entire disclosures of these patents being incorporated herein by reference.

Any suitable solvent may be used to form an adhesive layer coating solution. Typical solvents include tetrahydrofuran, toluene, hexane, cyclohexane, cyclohexanone, methylene chloride, 1,1,2-trichloroethane, monochlorobenzene, and the like, and mixtures thereof. Any suitable technique may be utilized to apply the adhesive layer coating. Typical coating techniques include extrusion coating, gravure coating, spray coating, wire wound bar coating, and the like. The adhesive layer is applied directly to the charge blocking layer. Thus, the adhesive layer of this invention is in direct contiguous contact with both the underlying charge blocking layer and the overlying charge generating layer to enhance adhesion bonding and to effect ground plane hole injection suppression. Drying of the deposited coating may be effected by any suitable conventional process such as oven drying, infra red radiation drying, air drying and the like. The adhesive layer should be continuous. Satisfactory results are achieved when the adhesive layer has a thickness between about 0.03 micrometer and about 2 micrometers after drying. Preferably, the dried thickness is between about 0.05 micrometer and about 1 micrometer. At thickness of less than about 0.03 micrometer, the adhesion between the charge generating layer and the blocking layer is poor and delamination can occur when the photoreceptor belt is transported over small diameter supports such as rollers and curved skid plates. When the thickness of the adhesive layer of this invention is greater than about 2 micrometers, excessive residual charge buildup is observed during extended cycling.

The charge generating layer of the photoreceptor of this invention comprises any suitable photoconductive particle dispersed in a film forming binder. Typical photoconductive particles include, for example, phthalocyanines such as metal free phthalocyanine, copper phthalocyanine, titanyl phthalocyanine, hydroxygallium phthalocyanine, vanadyl phthalocyanine and the like, perylenes such as benzimidazole perylene, trigonal selenium, quinacridones, substituted 2,4-diamino-triazines, polynuclear aromatic quinones, and the like. Especially preferred photoconductive particles include hydroxygallium phthalocyanine, benzimidazole perylene and trigonal selenium.

Typical perylene pigments particles include, for example, perylenes represented by the following cis and trans structures and mixtures thereof:

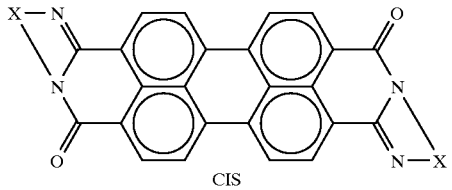

CIS

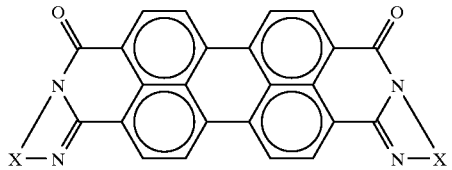

TRANS wherein X is o-phenylene, pyridimediyl, pyrimidinediyl, phenanthrenediyl, naphthalenediyl, and the corresponding methyl, nitro, chloro, and methoch substituted derivatives.

It is preferred that the perylene pigment is benzimidazole perylene which is also referred to as bis(benzimidazole). This pigment exists in the cis and trans forms and mixtures of these forms. The cis form is also called bis-benzimidazo (2,1-a-1',1'-b) anthra (2,1,9-def:6,5,10-d'e'f') disoquinoline-6,11-dione. The trans form is also called bisbenzimidazo (2,1-a1', 1'-b) anthra (2,1,9-def:6,5,10-d'e'f') disoquinoline-10,21-dione. The cis form may be represented by the following formula:

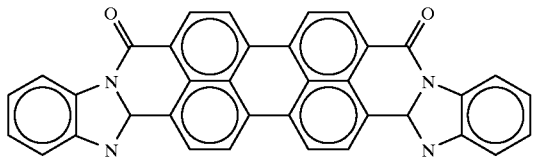

The trans form may be represented by the following formula:

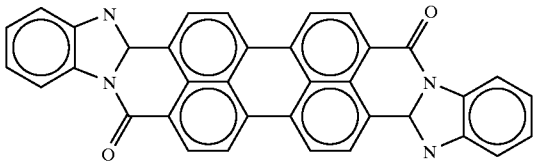

The benzimidazole perylene pigment may be prepared by reacting perylene 3,4,9,10-tetracarboxylic acid dianhydride with 1,2-phenylene.

Benzimidazole perylene is ground into fine particles having an average particle size of less than about 1 micrometer and dispersed in a preferred polycarbonate film forming binder of poly(4,4'-diphenyl-1,1'-cyclohexane carbonate). Optimum results are achieved with a pigment particle size between about 0.2 micrometer and about 0.3 micrometer. Benzimidazole perylene is described in U.S. Pat. No. 5,019,473 and U.S. Pat. No. 4,587,189, the entire disclosures thereof being incorporated herein by reference.

Any suitable film forming binder material may be employed in the charge generator layer. Typical organic resinous binders include, for example, polyvinyl butyral, polycarbonates, acrylate polymers, vinyl polymers, cellulose polymers, polyesters, polysiloxanes, polyamides, polyurethanes, epoxies, and the like. Many film forming binder are disclosed, for example, in U.S. Pat. No. 3,121,006 and U.S. Pat. No. 4,439,507, the entire disclosures of which are incorporated herein by reference. The film forming polymers may be block, random or alternating copolymers. The photogenerating particles are present in the film forming binder composition in various amounts. Preferred film forming polymers include poly(4,4'-diphenyl-1,1'-cyclohexane carbonate) and polystyrene/polyvinylpyridene copolymers. Polystyrene/vinylpyridene copolymers include, for example, AB block copolymers of polystyrene/poly-4-vinylpyridene having a weight average molecular weight of from about 7,000 to about 80,000, and more preferably from about 10,500 to about 40,000 and wherein the percentage of vinylpyridene is from about 5 to about 55 and preferably from about 9 to about 20. Block copolymers of polystyrenelpolyvinylpyridene are known in the art and described, for example in U.S. Pat. No. 5,384,223, U.S. Pat. No. 5,484,223, and U.S. Pat. No. 5,571,649, the entire disclosure of these three patents being incorporated herein by reference. Electrical life is improved dramatically by the use of poly(4,4'-diphenyl-1,1'-cyclohexane carbonate) film forming binder. Poly(4,4'-diphenyl-1,1'-cyclohexane carbonate) has repeating units represented in the following formula:

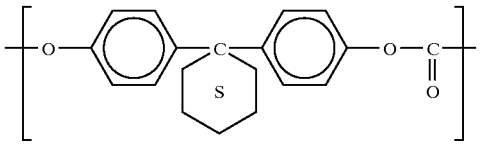

wherein "S" in the formula represents saturation. Preferably, the film forming polycarbonate binder for the charge generating layer has a weight average molecular weight between about 20,000 and about 140,000. Satisfactory results may be achieved when the dried charge generating layer contains between about 20 percent and about 90 percent by volume benzimidazole perylene dispersed in poly(4,4'-diphenyl-1,1 '-cyclohexane carbonate) based on the total volume of the dried charge generating layer. Preferably, the perylene pigment is present in an amount between about 30 percent and about 80 percent by volume. Optimum results are achieved with an amount between about 35 percent and about 45 percent by volume. Poly(4,4'-diphenyl-1,1'-cyclohexane carbonate) allow a reduction in perylene pigment loading without an extreme loss in photosensitivity.

Any suitable solvent may be utilized to dissolve the film forming binder. Typical solvents include, for example, tetrahydrofuran, toluene, methylene chloride, and the like. Tetrahydrofuran is preferred because it has no discernible adverse effects on xerography and has an optimum boiling point to allow adequate drying of the generator layer during a typical slot coating process. Coating dispersions for charge generating layer may be formed by any suitable technique using, for example, attritors, ball mills, Dynomills, paint shakers, homogenizers, microfluidizers, and the like.

Any suitable coating technique may be used to apply coatings. Typical coating techniques include slot coating, gravure coating, roll coating, spray coating, spring wound bar coating, dip coating, draw bar coating, reverse roll coating, and the like.

Any suitable drying technique may be utilized to solidify and dry the deposited coatings. Typical drying techniques include oven drying, forced air drying, infrared radiation drying, and the like.

Satisfactory results may be achieved with a dry charge generating layer thickness between about 0.3 micrometer and about 3 micrometers. Preferably, the charge generating layer has a dried thickness of between about 1.1 micrometers and about 2 micrometers. The photogenerating layer thickness is related to binder content. Thicknesses outside these ranges can be selected providing the objectives of the present invention are achieved.

Any suitable charge transport layer may be utilized. The active charge transport layer may comprise any suitable transparent organic polymer of non-polymeric material capable of supporting the injection of photo-generated holes and electrons from the charge generating layer and allowing the transport of these holes or electrons through the organic layer to selectively discharge the surface charge. The charge transport layer in conjunction with the generation layer in the instant invention is a material which is an insulator to the extent that an electrostatic charge placed on the transport layer is not conducted in the absence of illumination. Thus, the active charge transport layer is a substantially non-photoconductive material which supports the injection of photogenerated holes from the generation layer.

An especially preferred transport layer employed in one of the two electrically operative layers in the multilayer photoconductor of this invention comprises from about 25 to about 75 percent by weight of at least one charge transporting aromatic amine compound, and about 75 to about 25 percent by weight of a polymeric film forming resin in which the aromatic amine is soluble. A dried charge transport layer containing between about 40 percent and about 50 percent by weight of the small molecule charge transport molecule based on the total weight of the dried charge transport layer is preferred.

The charge transport layer forming mixture preferably comprises an aromatic amine compound. Most preferably, the charge transport layer comprises an arylamine small molecule dissolved or molecularly dispersed in a polycarbonate. Typical aromatic amine compounds include triphenyl amines, bis and poly triarylamines, bis arylamine ethers, bis alkyl-arylamines and the like.

Examples of charge transporting aromatic amines for charge transport layers capable of supporting the injection of photogenerated holes of a charge generating layer and transporting the holes through the charge transport layer include, for example, triphenylmethane, bis(4-diethylamine-2-methylphenyl)phenylmethane; 4'-4"-bis(diethylamino)-2', 2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyvinylcarbazole, polyester, polyarylate, polyacrylate, polyether, polysulfone, and the like. Weight average molecular weights can vary from about 20,000 to about 1,500,000.

The preferred electrically inactive resin materials are polycarbonate resins have a molecular weight from about 20,000 to about 120,000, more preferably from about 50,000 to about 100,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'- isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A. G.; a polycarbonate resin having a molecular weight of from about 20,000 to about 50,000 available as Merlon from Mobay Chemical Company; and poly(4,4'-diphenyl-1,1'-cyclohexane carbonate) available as PCZ -200 from Mitsubishi Gas Chemical.

Examples of photosensitive members having at least two electrically operative layers including a charge generator layer and diamine containing transport layer are disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507. The disclosures of these patents are incorporated herein in their entirety.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Coated photoreceptors containing polyethylene naphthalate substrates may be dried at a higher drying temperature than coated photoreceptors containing polyethylene terephthalate substrates. The use of higher drying temperatures to dry the photoconductive layers, particularly the charge transport layer, reduces stress in the photoreceptor and promotes a flatter photoreceptor that is resistant to curl. Photoreceptor belts containing polyethylene terephthalate substrates tend to deform during high temperature coating drying operations. This affects camber of the coated web and conicity of the final welded photoreceptor belt. However, coated photoreceptor webs containing polyethylene naphthalate substrates can be dried at much higher temperatures than coated photoreceptor webs contain polyethylene terephthalate substrates. Typically, coatings applied to photoreceptor webs contain polyethylene terephthalate substrates are dried at a temperature of about 135° C. Thus, even when higher temperature coating drying conditions are utilized, photoreceptors containing polyethylene naphthalate substrates show no detectable deformation thereby avoiding camber and conicity problems due to shrinkage at one edge of the coated web compared to the operative edge. For example, measurements of the shrinkage of polyethylene naphthalate and polyethylene terephthalate at photoreceptor drying temperatures of 135° C., there was a 4 fold improvement in shrinkage and a 4 fold reduction in camber. Generally, the thickness of the transport layer is between about 5 micrometers to about 100 micrometers, but thicknesses outside this range can also be used. A dried thickness of between about 18 micrometers and about 35 micrometers is preferred with optimum results being achieved with a thickness between about 24 micrometers and about 29 micrometers.

Although a charge transport layer formed on a photoreceptor having a polyethylene terephthalate substrate layer has an outer surface resembling a wave pattern, surprisingly, the size of the waves on the outer surface of a charge transport layer applied to a polyethylene naphthalate substrate is much lower than that applied to a polyethylene terephthalate substrate. The peak to valley distance of the waves on the surface of a charge transport layer applied to a charge generating layer on a polyethylene terephthalate substrate having a thickness of 76 micrometers (3 mils) is 300 micrometers to 600 micrometers. The peak to valley distance measured in a direction perpendicular to the surface of the substrate of waves on the surface of a charge transport layer applied to a charge generating layers supported on a polyethylene naphthalate substrate having a thickness of 90 micrometers (3.5 mils) is only about 30 to 150 micrometers. The peak to valley distance on the outer surface of a charge transport layer in a photoreceptor containing a polyethylene naphthalate substrate layer having a thickness of 76 micrometers (3 mils) is about 100 micrometers to about 250 micrometers. Thus, the wavy pattern on the outer surface of a photoreceptor of this invention is substantially less in amplitude.

Other layers such as conventional ground strips comprising, for example, conductive particles disposed in a film forming binder may be applied to one edge of the photoreceptor in contact with the zirconium and/or titanium layer, blocking layer, adhesive layer or charge generating layer.

Optionally, an overcoat layer may also be utilized to improve resistance to abrasion. In some cases a back coating may be applied to the side opposite the photoreceptor to provide flatness and/or abrasion resistance. These overcoating and backcoating layers may comprise organic polymers or inorganic polymers that are electrically insulating or slightly semi-conductive.

Generally, the photoreceptor is fabricated by applying coatings to a web shaped substrate and the resulting coated web is cut into sheets. Opposite ends of the sheet are thereafter joined by any suitable technique such as by ultrasonic welding. If desired, joining may be effected by other methods such as with adhesives, tapes, and the like. These joining techniques are well known in the art. A typical welding process is described in U.S. Pat. No. 4,878,985, the entire disclosure thereof being incorporated herein by reference. The welded belt may optionally be treated to release stress in the seam area. Stress release may be accomplished by heating the seam area of the belt to a temperature above the glass transition temperature while the seam region of the belt is bent over a support having an arcuate surface. After heating, the seam is cooled to ambient temperature while it is still bent over the support. Because the initial rectangular shape of the belt of this invention is maintained substantially intact and camber is avoided during the coating, drying and welding operations, the conicity of the belt can be precisely predicted. Thus, electrophotographic imaging belts of this invention can be fabricated with a difference in conicity significantly less than belts fabricated with polyethylene terephthalate substrates. The belt of this invention can be mounted in electrophotographic imaging copiers, printers and duplicators without any major adjustments to compensate for large difference in conicity from one edge of the belt to the other edge. Thus, for example, a polyethylene naphthalate substrate belt of this invention having an 87.5 micrometer (3.5 mill) thickness has been electrophotographically cycled in an electrophotographic imaging system more than 600,000 electrophotographic imaging cycles.

Some of the improved mechanical properties achieved include increased flatness, higher elastic modulus which resists stretching or distortion, and flatter welded joints. Thus, for example, the belt lies flatter when supported on backer bars. Further, large segments of a coated web have less camber so that there is more uniform conicity (i.e., more uniform circumference across the width of the web) after the segment is cut and the opposite ends welded together. The combination of layers in the photoreceptor of this invention can achieve a flatness equal to or less than about 300 micrometers. The measurement technique for measuring this flatness is described in Example VI below. Also, shrinkage of the photoreceptor of this invention imaging member is less than about 0.5 percent in the machine direction when exposed to a temperature of 130° C. for 30 minutes. The expression "machine directions" as employed herein is defined as in a direction parallel to the movement of the photoreceptor during xerographic image cycling.

It has been found that when a polyethylene naphthalate is employed as a substrate, the photoreceptor belt lies flatter and the thickness of the photoconductive layers on the belt are more uniform. It is believed that the presence of fewer oligomers in the polyethylene naphthalate substrate of this invention results in fewer defects in the applied photoconductive coatings thereby resulting in a reduction of defects. Photoreceptor belts containing polyethylene terephthalate substrates tend to deform during high temperature coating drying operations. This adversely affects camber of the coated web and conicity of the final welded photoreceptor belt. However, coated photoreceptor webs containing polyethylene naphthalate substrates can be dried at much higher temperatures than coated photoreceptor webs contain polyethylene terephthalate substrates. Thus, even when higher temperature coating drying conditions are utilized, photoreceptors containing polyethylene naphthalate substrates show no detectable deformation thereby avoiding camber and conicity problems due to shrinkage at one edge of the coated web compared to the opposite edge. Further with a 3 to 5 mils thick polyethylene naphthalate substrate, mechanical life is improved. In addition, less power is required to achieve a welded seam having acceptable mechanical properties. Further, the polyethylene naphthalate substrate photoreceptors of this invention may be utilized in electrophotographic imaging systems generating a high temperature environment such as imaging systems that have a rapid first copy out feature where the fuser temperature is increased dramatically to achieve the shorter fusing times needed for a more rapid first copy out. Generally, high belt tension is need to help flatten a photoreceptor belt containing polyethylene terephthalate substrates. These high tensions, particularly at high temperatures damage the charge transport layer of the photoreceptor. Since less tension is needed to for photoreceptor containing polyethylene naphthalate substrates of this invention to achieve a flat belt and since such lower tensions reduces the likelihood of stretching, the charge transport layer is more resistant to damage. Also, because belt photoreceptors containing polyethylene naphthalate substrates of this invention are flatter, the coatings thereon are more uniform, the deposit of electrostatic charge is more uniform and the final image is more uniform. Moreover, the coatings on a polyethylene naphthalate substrate of this invention exhibit fewer surface defects. Thus, more complete development of the electrostatic latent image and more complete transfer of the deposited toner image occurs with photoreceptors containing polyethylene naphthalate substrates of this invention. Also unexpected, is that the wavy characteristic of the outer surface of a charge transport layer applied to a polyethylene naphthalate substrate of this invention is much lower than that applied to a polyethylene terephthalate substrate. Unlike polyethylene terephthalate substrate belts, the polyethylene naphthalate substrate belts of this invention resist shrinkage and stretching under high tension and high temperature operating conditions.

The invention will now be described in detail with respect to the specific preferred embodiments thereof, it being understood that these examples are intended to be illustrative only and that the invention is not intended to be limited to the materials, conditions, process parameters and the like recited herein. All parts and percentages are by weight unless otherwise indicated.

COMPARATIVE EXAMPLE I

A polyethylene terephthalate (Melinex, available from ICI Americas Inc.) substrate having a thickness of 76 micrometers was vacuum coated by sputtering with a titanium layer having a thickness of about 100 Angstroms. Without breaking the vacuum, the titanium layer was coated by sputtering a zirconium metal layer having a thickness of about 100 Angstroms. The exposed zirconium surface was oxidized by exposure to oxygen in the ambient atmosphere. A siloxane hole blocking layer was prepared by applying a 0.22 percent (0.001 mole) solution of 3-aminopropyl triethoxylsilane to the oxidized surface of the zirconium layer with a gravure applicator. The deposited coating was dried at 135° C. in a forced air oven to form a layer having a thickness of 120 Angstroms. A coating of polyester resin (duPont 49,000, available from I. I. DuPont de Nemours & Co.) was applied to the siloxane coated base with a gravure applicator. The polyester resin was dried to form a film having a thickness of about 0.05 micrometer. A slurry coating solution of 40 percent by volume benzimidazole perylene and 60 percent by volume poly(4,4'-diphenyl-1,1'-cyclohexane carbonate (PCZ-200, available from Mitsubishi Gas Chem.) dispersed in tetrahydrofuran was extrusion coated onto the polyester coating to form a layer having a wet thickness of about 26 micrometers. The coated member was dried at 135° C. in a forced air oven to form a layer having a thickness of about 1 micrometer. A charge transport layer was formed on this charge generator layer by applying a mixture of a 60-40 by weight solution of Makrolon, a polycarbonate resin having a molecular weight from about 50,000 to about 100,000 available from Farbenfabriken Bayer A. G. and N,N'-diphenyl-N,N'-bis(3-methylphenyl)-[1,1'-biphenyl]-4,4'-diamine dissolved in methylene chloride to give a 15 percent by weight solution. The components were extrusion coated on top of the generator layer and dried at temperature of about 135° C. to form a 24 micrometer thick dry layer of hole transporting material. A grounding strip coating and an anti curl backing coating were also applied. This photoreceptor was then cut and welded by conventional ultrasonic welding to form a continuous belt. The belt was 353 millimeters wide and 836 millimeters in circumference.

EXAMPLE II

A photoconductive imaging member was prepared as described in Comparative Example I, except that the web of titanium and zirconium coated polyethylene terephthalate (Melinex, available from ICI Americas Inc.) substrate having a thickness of 76 micrometers was substituted by a web of titanium and zirconium coated polyethylene naphthalate (Kaladex, available from ICI Films) substrate having a thickness of 76 micrometers. The polyethylene naphthalate substrate was substantially free of any oligomers, had a glass transition temperature of about 110° C. and had a Young's Modulus of 871,000 pounds per square inch.

EXAMPLE III

A photoconductive imaging member was prepared as described in Comparative Example I, except that the web of titanium and zirconium coated polyethylene terephthalate (Melinex, available from ICI Americas Inc.) substrate having a thickness of 76 micrometers was substituted by a web of titanium and zirconium coated polyethylene naphthalate (Kaladex, available from ICI Films) substrate having a thickness of 90 micrometers. The polyethylene naphthalate substrate was substantially free of any oligomers, had a glass transition temperature of about 110° C. and had a Young's Modulus of 871,000 pounds per square inch.

EXAMPLE IV

A photoconductive imaging member was prepared as described in Comparative Example I, except that the web of titanium and zirconium coated polyethylene terephthalate (Melinex, available from ICI Americas Inc.) substrate having a thickness of 76 micrometers was substituted by a web of titanium and zirconium coated polyethylene naphthalate (Kaladex, available from ICI Films) substrate having a thickness of 100 micrometers. The polyethylene naphthalate substrate was substantially free of any oligomers, had a glass transition temperature of about 110° C. and had a Young's Modulus of 871,000 pounds per square inch.

EXAMPLE V

A photoconductive imaging member was prepared as described in Comparative Example I, except that the web of titanium and zirconium coated polyethylene Terephthalate (Melinex, available from ICI Americas Inc.) substrate having a thickness of 76 micrometers was substituted by a web of titanium and zirconium coated polyethylene naphthalate (Kaladex, available from ICI Films) substrate having a thickness of 125 micrometers. The polyethylene naphthalate substrate was substantially free of any oligomers, had a glass transition temperature of about 110° C. and had a Young's Modulus of 871,000 pounds per square inch.

EXAMPLE VI

The mechanical flatness properties of photoconductive imaging members of Examples I through V were evaluated by mounting the devices in a tri roller mechanical fixture consisting of two twenty five millimeter diameter rollers mounted with centers located 63 millimeters apart, and a third thirty millimeter diameter roller mounted in a spring loaded holder oriented perpendicular to the line connecting the centers of the first two rollers, midway between the rollers. The third roll maintains a belt tension of 192.6 newton per meter. The flatness was evaluated by mechanically scanning a laser triangulation sensor (Keyence LC-2440, available from the Keyence Corporation of America) along a line midway between the two 25 millimeter diameter rollers. The peak to peak variation in surface position for the device described in Example I was about 500 micrometers, the peak to peak variation in surface position for the device described in Example II was about 300 micrometers, the peak to peak variation in surface position for the device described in Example III was about 100 micrometers, and the peak to peak variation in surface position for the devices described in Examples IV and V were less than 100 micrometers. All of the examples fabricated with the polyethylene naphthalate exhibited flatness properties that are superior to those observed in Example I.

EXAMPLE VII

A photoconductive imaging member was prepared as described in Example I, except that the sample size was 2500 millimeters in circumference and 414 millimeters in width.

EXAMPLE VIII

A photoconductive imaging member was prepared as described in Example II, except that the sample size was 2500 millimeters in circumference and 414 millimeters in width.

EXAMPLE IX

A photoconductive imaging member was prepared as described in Example IV, except that the sample size was 2500 millimeters in circumference and 414 millimeters in width.

EXAMPLE X

A photoconductive imaging member was prepared as described in Example V, except that the sample size was 2500 millimeters in circumference and 414 millimeters in width.

EXAMPLE XI

The devices fabricated in Examples VII through X were measured on a circumference gauge to determine the actual belt circumference. Each sample was measured at the time of fabrication, 16 days later, and 50 days later to determine the amount of shrinkage. Example VII, the polyethylene terephthalate reference material, shrank 1.2 millimeters in 16 days and shrank 1.8 millimeters in 50 days. Example VIII shrank 0.8 millimeters in 16 days and 0.9 millimeters in 50 days. Example IV shrank 0.8 millimeters in 16 days and 0.9 millimeters in 50 days. Example X shrank 0.6 millimeters in 16 days and 0.7 millimeters in 50 days. The polyethylene naphthalate samples in this test had about one half the amount of shrinkage of the polyethylene terephthalate reference material.

EXAMPLE XII

The 836 millimeter circumference devices fabricated in Examples I, II, IV, and V were measured on a circumference gauge at the time of fabrication and 44 days later to determine the amount of shrinkage. Example I shrank 0.7 millimeter, Example II shrank 0.4 millimeter, Example IV shrank 0.3 millimeter and Example V shrank 0.25 millimeter.

While the embodiment disclosed herein is preferred, it will be appreciated from this teaching that various alternative, modifications, variations or improvements therein may be made by those skilled in the art, which are intended to be encompassed by the following claims.

What is claimed is:

1. An electrophotographic imaging member comprising a support substrate layer comprising polyethylene naphthalate substantially free of any oligomers, having a glass transition temperature of between about 100° C. and about 140° C., having a thickness between about 75 micrometers and about 125 micrometers and having a Young's modulus of between about 650,000 and about 1,000,000 pounds per square inch, an electrically conductive ground plane layer comprising titanium, a hole blocking layer, an optional adhesive layer, a charge generation layer comprising photoconductive particles dispersed in a film forming binder, and a hole transport layer, the hole transport layer being substantially non-absorbing in the spectral region at which the charge generation layer generates and injects photogenerated holes but being capable of supporting the injection of photogenerated holes from the charge generation layer and transporting the holes through the hole transport layer.

2. An electrophotographic imaging member according to claim 1 wherein the hole transport layer has an outer surface, the outer surface having a wavy pattern with a peak to valley distance measured in a direction perpendicular to the surface of the substrate between about 30 micrometers and 250 micrometers.

3. An electrophotographic imaging member according to claim 1 wherein the adhesive layer comprises a film forming resin comprising a copolyester.

4. An electrophotographic imaging member according to claim 3 wherein the copolyester film forming resin in said adhesive layer is a linear saturated copolyester reaction product of ethylene glycol with terephthalic acid, isophthalic acid, adipic acid and azelaic acid.

5. An electrophotographic imaging member according to claim 1 wherein the adhesive layer comprises a film forming resin comprising a polyarylate.

6. An electrophotographic imaging member according to claim 1 wherein the adhesive layer comprises a film forming resin comprising a polyurethane.

7. An electrophotographic imaging member according to claim 1 wherein the imaging member has a flatness equal to or less than 300 micrometers.

8. An electrophotographic imaging member according to claim 1 wherein the photoconductive particles are hydroxygallium phthalocyanine particles.

9. An electrophotographic imaging member according to claim 1 wherein the photoconductive particles are benzimidazole perylene particles.

10. An electrophotographic imaging member according to claim 1 wherein the photoconductive particles are trigonal selenium particles.

11. An electrophotographic imaging member according to claim 1 wherein the film forming binder in the charge generation layer comprises poly(4,4'-diphenyl-1,1'-cyclohexane carbonate).

12. An electrophotographic imaging member according to claim 1 wherein the film forming binder in the charge generation layer comprises polystyrene/polyvinylpyridene copolymer.

13. An electrophotographic imaging member according to claim 1 wherein the conductive ground plane has a total thickness of between about 100 angstroms and about 300 angstroms and comprises the titanium layer overcoated with a zirconium layer.

14. An electrophotographic imaging member according to claim 1 wherein the zirconium layer has a thickness of at least about 60 angstroms.

15. An electrophotographic imaging member according to claim 1 wherein the hole blocking layer comprises a siloxane.

16. An electrophotographic imaging member according to claim 15 wherein the siloxane is an amino siloxane.

17. An electrophotographic imaging member according to claim 1 wherein the perylene is benzimidazole perylene.

18. An electrophotographic imaging member according to claim 1 wherein the charge generation layer comprises between about 20 percent about 90 percent by volume of the benzimidazole perylene particles, based on the total volume of the charge generation layer.

* * * * *